US005263551A

United States Patent [19]

Andersen

[11] Patent Number: 5,263,551

[45] Date of Patent: Nov. 23, 1993

[54] DEVICE FOR USE IN CARPENTRY AND PAINTING

[76] Inventor: Terry M. Andersen, 5624 Cloverland Dr., Brentwood, Tenn. 37027

[21] Appl. No.: 945,013

[22] Filed: Sep. 14, 1992

Related U.S. Application Data

[63] Continuation-in-part of Ser. No. 817,342, Jan. 6, 1992, abandoned.

[51] Int. Cl.[5] ..... E04C 3/00

[52] U.S. Cl. ..... 182/200; 182/107; 182/129; 248/188.2

[58] Field of Search ..... 182/200, 109, 107, 170, 182/214, 129, 45; 248/911, 912, 238, 188.2, 237

[56] References Cited

U.S. PATENT DOCUMENTS

| | | | |
|---|---|---|---|
| 1,886,921 | 11/1932 | Tobin | 248/237 X |
| 3,920,097 | 11/1975 | Brebner | 182/107 |
| 3,993,275 | 11/1976 | Lucas | 182/107 X |
| 4,069,890 | 1/1978 | Gottliebsen | 182/200 X |
| 4,304,318 | 12/1981 | Webb | 182/200 X |
| 4,342,374 | 8/1982 | Montana | 182/200 X |
| 4,457,397 | 7/1984 | Scala | 182/107 X |
| 4,469,193 | 9/1984 | Rumsey, Jr. | 182/107 X |
| 4,699,247 | 10/1987 | Clarke | 182/200 X |
| 4,830,320 | 5/1989 | Bellows | 248/188.2 |
| 4,870,440 | 9/1989 | Frost | 248/188.2 X |

FOREIGN PATENT DOCUMENTS

| | | | |
|---|---|---|---|
| 2156415 | 10/1985 | United Kingdom | 182/107 |
| 2160570 | 12/1985 | United Kingdom | 182/107 |

*Primary Examiner*—Karen J. Chotkowski

*Attorney, Agent, or Firm*—Edward D. Lanquist, Jr.; Mark J. Patterson; I. C. Waddey, Jr.

[57] ABSTRACT

The present invention discloses a device for use in carpentry, painting, and other construction. The device has two side members shaped generally as quadrilaterals with the first side member being a mirror image of the second side member. A first surface joins a first edge of the first side member to a fifth edge of the second side member. A second surface joins a second edge of the first side member to a sixth edge of the second side member. The fourth edge of the first side member and the eighth edge of the second side member have teeth which engage a surface. The fourth edge and the eighth edge also have cut outs which assist in engaging a ladder. A handle can be provided for easy carrying. A third surface joins the first side member to the second side member.

11 Claims, 4 Drawing Sheets

DEVICE FOR USE IN CARPENTRY AND PAINTING

This is a continuation-in-part of pending U.S. patent application Ser. No. 817,342 filed on Jan. 6, 1992 and now abandoned.

BACKGROUND OF THE INVENTION

The present invention relates generally to a device for use in carpentry and painting and more particularly to device which can be used to carry tools and supplies, to level ladders, to support a platform, and the like.

It will be appreciated by those skilled in the art that in carpentry, apinting, and in other means of construction, work places are not often easily accessible. In certain instances, ladders and other objects must be placed on surfaces which would not otherwise provide a sufficient base. It will further be appreciated by those skilled in the art that a carpenter, painter, or other constructor can not carry around hundreds of tools necessary for hundreds of projects. One tool must perform several projects. It will further be appreciated by those skilled in the art that carpenters, painters, and other constructors require scaffolds and work benches. It will further be appreciated by those skilled in the art that carpenters, painters, and other constructors require something to carry around their tools. To this end, there have been several attempts to provide multi-purpose tools.

U.S. Pat. No. 4,469,193 issued to J. Rumsey, Jr. on Sep. 4, 1984, discloses a utility ladder which has a pyramidally-shaped base which can provide support for a ladder which has an otherwise level surface. Unfortunately, if the ground upon which the ladder is placed is not leveled from side to side, the utility ladder of Rumsey would not work.

U.S. Pat. No. 4,699,247 issued to J. Clarke on Oct. 13, 1987, discloses a ladder leveling device. Unfortunately, this device can only be used for this one purpose. Therefore, it is impractical for a carpenter, painter or other constructor to carry this device around.

Similarly, U.S. Pat. No. 4,457,397 issued to J. Scala on Jul. 3, 1984, provides a device for placing a platform on stairs. Unfortunately, this too is impractical because it serves only one purpose.

U.K. Patent Application No. 2,160,570A published on Dec. 24, 1985, discloses a skid pad which can be placed at the top of a ladder and a platform leveling pad which can be placed on the bottom of the level. Unfortunately, this requires two devices each performing one purpose.

U.K. Patent Application No. 2,156,415A published on Oct. 9, 1985, discloses a ladder level. Unfortunately, this ladder level can only be used for its stated purpose.

U.S. Pat. No. 1,886,921 issued to R. Tobin on Nov. 8, 1932, discloses a scaffold for support which must be attached to either a ladder or a roof. Unfortunately, it can only be used for its stated purpose.

U.S. Pat. No. 4,342,374 issued to A. Montana on Aug. 3, 1982, discloses a ladder leveling device which is to be used in connection with a roof. Unfortunately, it can only be used for its stated purpose.

U.S. Pat. No. 4,069,890 issued to L. Gottliebsen on Jan. 24, 1978, provides a device for leveling a ladder from side to side. It can not be used for any other purpose.

U.S. Pat. No. 4,304,318 issued to A. Webb on Dec. 8, 1981 can only be used to level a ladder from side to side. It can be used for no other purpose.

U.S. Pat. No. 3,993,275 issued to E. Lucas on Nov. 23, 1976, provides merely a cumbersome ladder support structure which can perform no other purpose.

U.S. Pat. No. 3,920,097 issued to R. Brebner on Nov. 18, 1975, provides a supports for placing a ladder on a stairwell. It can be used for no other purpose.

What is needed, then, is a single device which can be used to create a scaffold on a ladder. This needed device must also be capable of use to provide a scaffold on a roof without a ladder. This needed device must be capable of side to side leveling of a ladder. This needed device must be capable of being used in connection with steep or gentle sloping roofs. This needed device must be capable of leveling a ladder on stairsteps. This needed device must be capable of use as a door block or a tire block. This needed device must be capable of being used to dry airbrushes. This needed device must be capable of being used to carry tools. This needed device must be capable of being used as a sawhorse plank. This needed device must be capable of use with a step stool. This needed device is presently lacking in the prior art.

SUMMARY OF THE INVENTION

The present invention discloses a device for use in carpentry, painting, and other construction. The device has two side members shaped generally as quadrilaterals with the first side member being a mirror image of the second side member. A first surface joins a first edge of the first side member to a fifth edge of the second side member. A second surface joins a second edge of the first side member to a sixth edge of the second side member. The fourth edge of the first side member and the eighth edge of the second side member have teeth which engage a surface. The fourth edge and the eighth edge also have cut outs which assist in engaging a ladder. A handle can be provided for easy carrying. A third surface joins the first side member to the second side member.

Accordingly, one object of the present invention is to provide a device which can level a ladder laterally.

Still another object of the present invention is to provide a device for leveling a surface upon which something can be placed.

Still another object of the present invention is to provide a device for leveling a ladder on either the ground or a roof.

Still another object of the present invention is to provide a device which is capable of engaging a ladder for providing support for a scaffold or other work piece.

Still another object of the present invention is to provide a device which can function as a sawhorse support.

A still further object of the present invention is to provide a block for either a door or a vehicle.

Still another object of the present invention is to provide a device which can be placed on stairs to level a ladder.

A still further object of the present invention is to provide a device which can be used to dry paint brushes.

Still another object of the present invention is to provide a device which can act as a tool or supply holder.

Still a further object of the present invention is to provide a device which can be used as a step stool.

DESCRIPTION OF THE PREFERRED EMBODIMENT

Figure 1A:
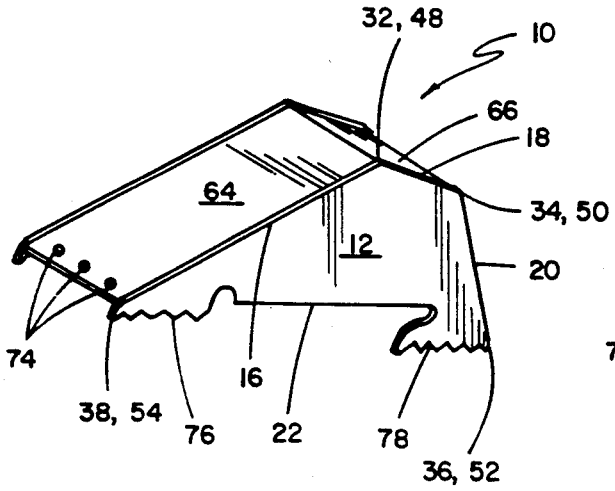
FIG. 1*a* is a perspective view of the device of the present invention.
Figure 1B:
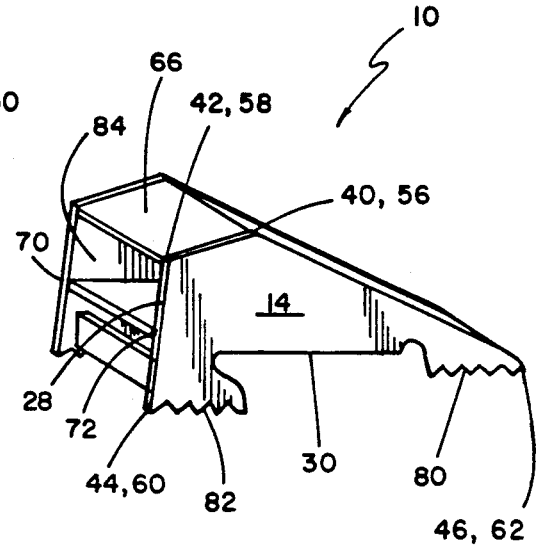
FIG. 1*b* is a perspective view of the device of the present invention.
Figure 1C:
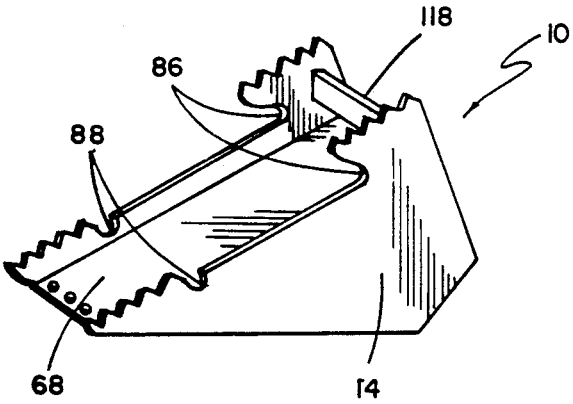
FIG. 1*c* is a perspective view of the device of the present invention.
Figure 1D:
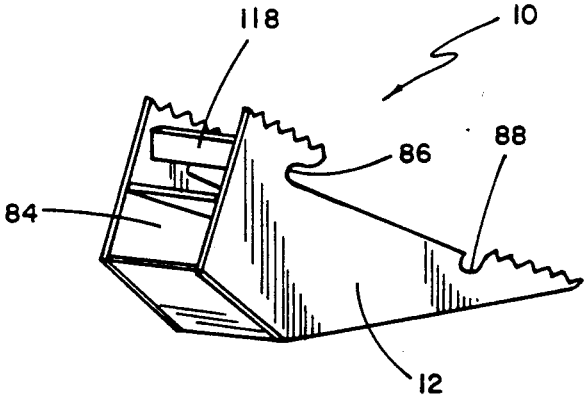
FIG. 1*d* is a perspective view of the device of the present invention.
Figure 1E:
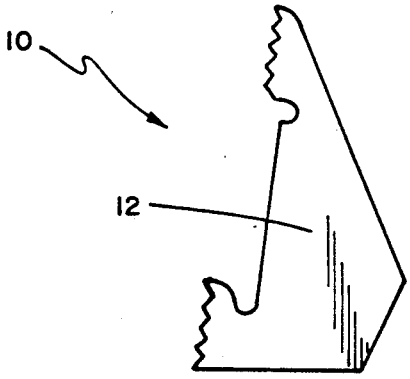
FIG. 1*e* is a side view of the device of the present invention.

Referring now to FIG. 1*a*–1*e* there is shown generally at 10 the device for use in carpentry, painting, and construction of the present invention. Device 10 has first side member 12 and second side member 14. Side members 12, 14 are substantially quadrilaterally-shaped and are mirror images of one another. First side member has first edge 16, second edge 18, third edge 20, and fourth edge 22 whereas second side member 14 has fifth edge 24, sixth edge 26, seventh edge 28, and eighth edge 30. First point 32 joins first edge 16 to second edge 18. Second point 34 joins second edge 18 to third edge 20. Third point 36 joins third edge 20 to fourth edge 22. Fourth point 38 joins fourth edge 22 to first edge 16. Similarly, fifth point 40 joins fifth edge 24 to sixth edge 26. Sixth point 42 joins sixth edge 26 to seventh edge 28. Seventh point 44 joins seventh edge 28 to eight edge 30. Eighth point 46 joins eighth edge 30 to fifth edge 24. First side member has first angle 48, second angle 50, third angle 52 and fourth angel 54 at points 32, 34, 36, and 38, respectively. Similarly, second side member 14 has fifth angle 40, sixth angel 42, seventh angle 44, and eighth angle 46 at points 40, 42, 44, and 46, respectively. In the preferred embodiment, angles 54, 62, 52, and 60 are acute angles whereas angles 48, 50, 58, and 56 are obtuse angles. In the preferred embodiment, angles 48 56 are substantially one hundred forty degrees (140°). In a preferred embodiment, angles 50, 58 are substantially one hundred ten degrees (110°). In the preferred embodiment, angles 52, 60 are substantially eighty degrees (80°). In the preferred embodiment, angles 54, 62 are substantially thirty degrees (30°). First surface 64 attaches to first side member along first edge 16 and second side member along fifth edge 24. In the preferred embodiment, first surface has holes 74 proximate to fourth point 38 and eight point 36 for receiving nails. Second surface 66 attaches to first side member along second edge 18 and along second side member along sixth edge 26. Third surface 68 attaches to first side member proximate to fourth point 38 and to second side member proximate to eighth point 46 at one end and to first side member at first intermediary point 70 and to second side member at second intermediary point 72 at a second end. First intermediary point 70 lyes between second point 34 and third point 36 whereas second intermediary member 72 lies between sixth point 42 and seventh point 44. First side member 12 has first teeth 76 proximate to fourth point 54 and second teeth 78 proximate to third point 36. Second side member has third teeth 80 proximate to eighth point 46 and fourth teeth 82 proximate to seventh point 44. In place of teeth, rubber padding can be used to enhance friction. As can be seen in FIG. 1*b*, the area between first surface 66 and third surface 70 is cavity 84 into which tools can be placed. Vertical ladder notches 86 are placed in side members 12, 14 proximate to third point 20 and seventh point 28 respectively. Similarly, horizontal ladder notches 88 are placed in side members 12, 14 proximate to first teeth 76 and third teeth 80, respectively.

Figure 2:
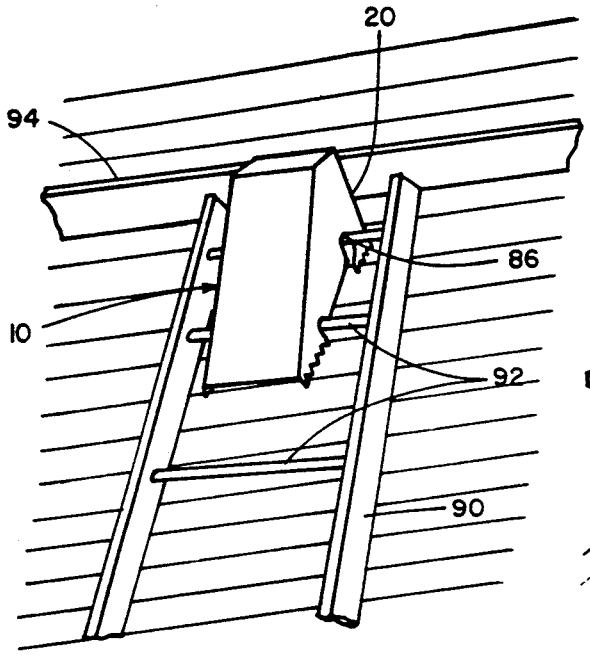
FIG. 2 is a perspective view of the device of the present invention as used in connection with a ladder.

Referring now to FIG. 2 there is shown generally at 10 the device of the present invention as used in connection with ladder 90 having rungs 92. Vertical ladder notches 86 engage rung 92' whereas horizontal ladder notches 88 engage rung 92''. This provides weights upon which scaffold board 94 can be placed on third edge 20 and seventh edge 28.

Figure 3:
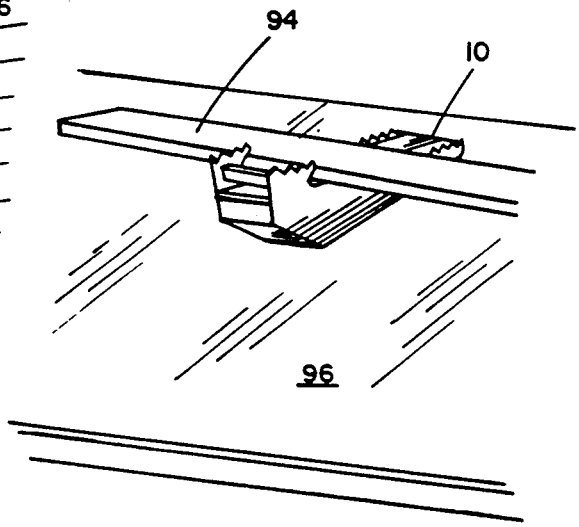
FIG. 3 is a perspective view of the device of the present invention as used on a gentle sloping roof.

Referring now to FIG. 3 there is shown generally at 10 device used in connection with roof 96 which is of gentle slope. By placing first surface 64 in contact with roof 96, scaffold board 94 can be placed over fourth edge 22 and eighth edge 30.

Figure 4:
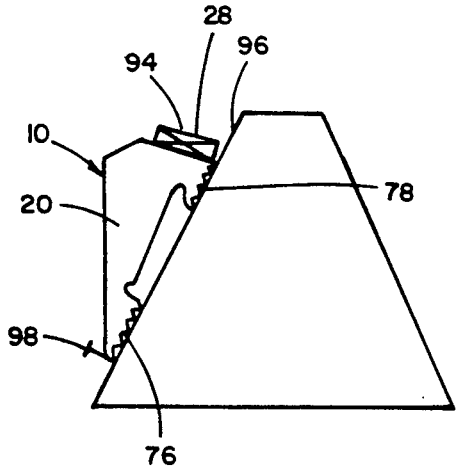
FIG. 4 is a side view of the device of the present invention as used in connection with a steep roof.

Referring now to FIG. 4 there is shown generally at 10 device as used in connection with roof 96 which is steep. In this instance, feet 76, 78 fictionally engage roof 96 and nail 98 is placed into hole 74 to insure the device does not move vertically. Scaffold board 94 can then be placed against third edge 20 and seventh edge 28.

Figure 5:
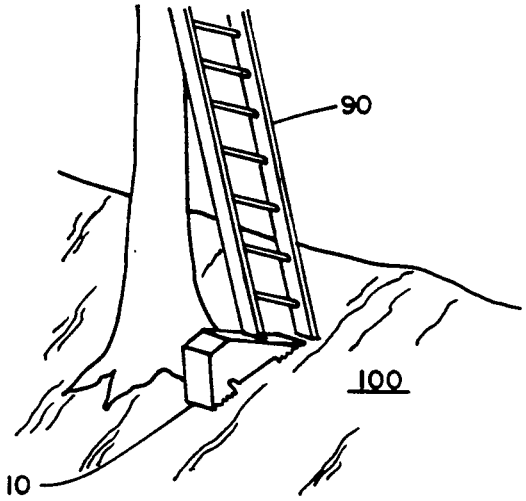
FIG. 5 is a perspective view of the device of the present invention shown leveling a ladder.

Referring now to FIG. 5 there is shown generally at 10 the device of the present invention as used to level ladder 90 on sloping ground 100. Ladder 90 is placed on first surface 64.

Figure 6:
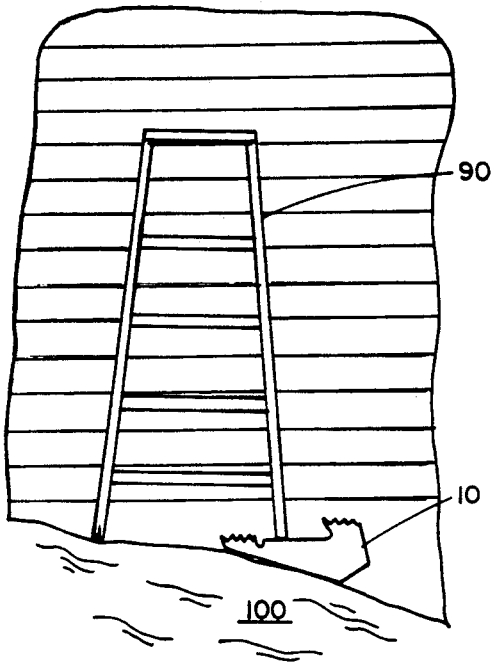
FIG. 6 is a frontal view of the device of the present invention as used in connection to level a ladder.

Referring now to FIG. 6 there is shown generally at 10 the device of the present invention as used to level ladder 90 on ground 100 which is sloping slightly. In this instance, ladder 90 is placed on third surface (68 in FIG. 1).

Figure 7:
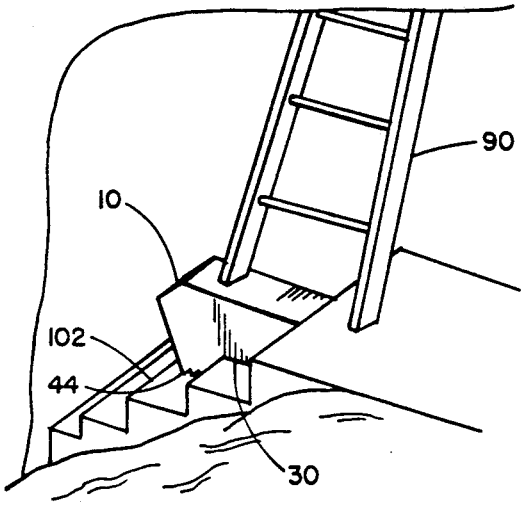
FIG. 7 is a perspective view of the device of the present invention used to level a ladder on a stair.

Referring now FIG. 7 there is shown generally at 10 device of the present invention as used in connection with stairs 102. Fourth edge 22 and eighth edge 30 are placed on upper steps with teeth 80, 76 engaging corner of stair with third point 36 and seventh point 44 and placed on lower step.

Figure 8:
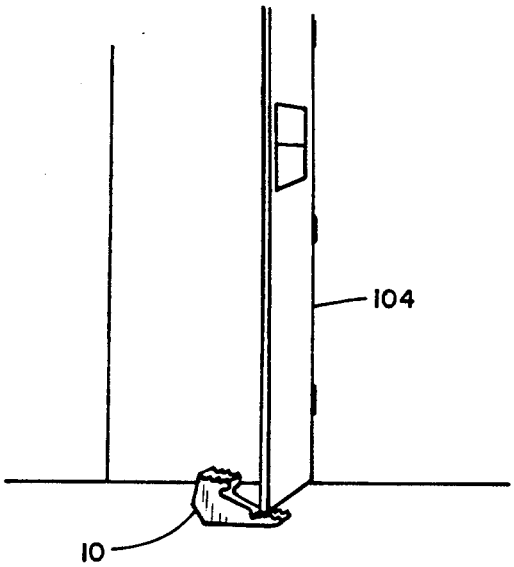
FIG. 8 is a perspective view of the device of the present invention to block a door open.
Figure 9:
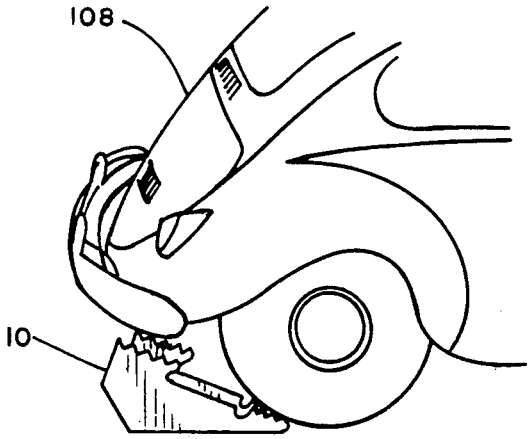
FIG. 9 is a perspective view of the device of the present invention used to block the tire of a car.

Referring now to FIGS. 8 and 9 there is shown generally at 10 the device of the present invention as used to block door 104 in FIG. 8 and tire 106 of car 108 in FIG. 9.

Figure 10:
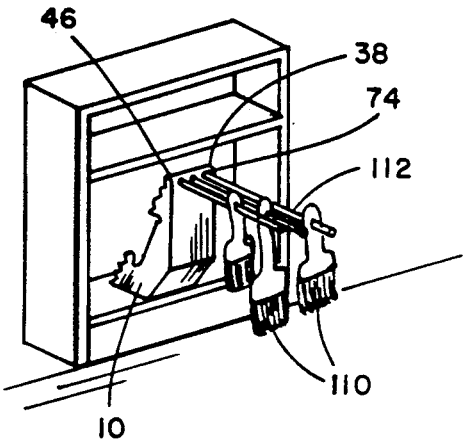
FIG. 10 is a side view of the device of the present invention used to hold and dry and paint brushes.

Referring now to FIG. 10 there is shown generally at 10 the device of the present invention as used to dry paint brushes 110. In this instance, wires 112 are placed into hole 74 with points 38, 46 facing upwardly.

Figure 11:
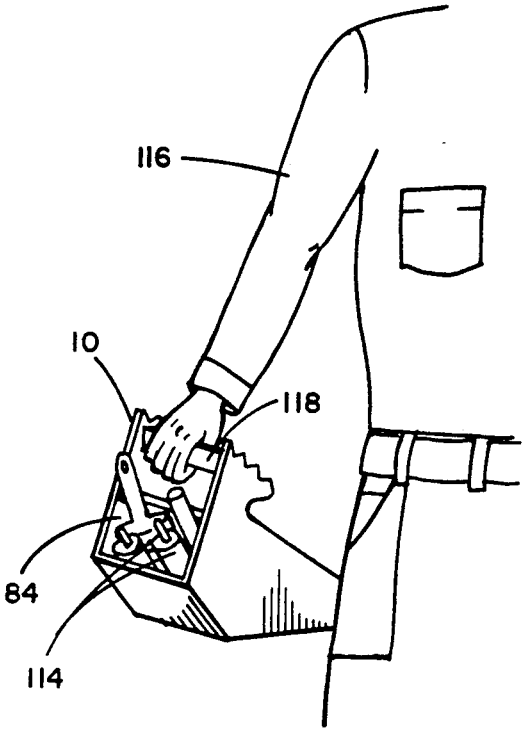
FIG. 11 is a frontal view of the device of the present invention as used to carry supplies.

Referring now to FIG. 11 there is shown generally at 10 the device of the present invention with cavity 84 containing supplies 114 with user 116 carrying device 10 using handle 118. Handle 118 is more clearly shown in FIGS. 1*c* and 1*d*.

Figure 12:
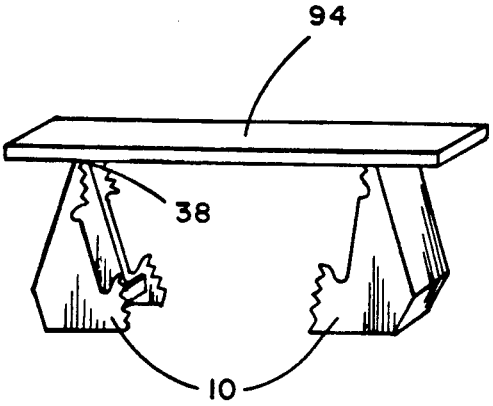
FIG. 12 is a frontal view of the device of the present invention used as a plank of a saw horse.

Referring now to FIG. 12 there is shown generally at 10 the use of the device of the present invention as a saw horse support scaffold plank 94 with point 38 facing upwardly.

Figure 13:
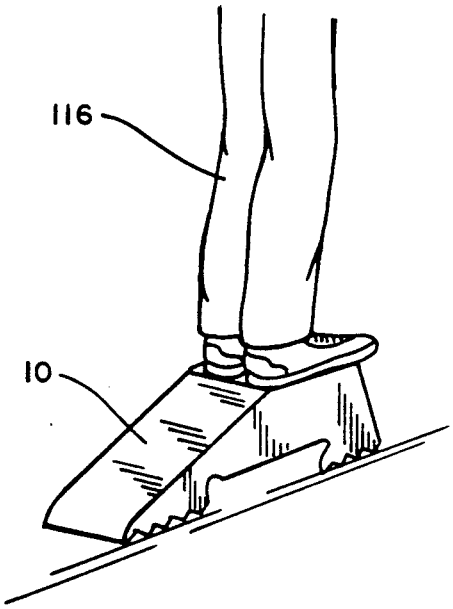
FIG. 13 is a perspective view of the device of the present invention used as a step stool.

Referring now to FIG. 13 there is shown generally at 10 the device of the present invention as used by user 16 as a step ladder with second surface 16 aligned substantially horizontally.

In the preferred embodiment, device 10 is made of wood. However, device 10 could also be molded out of plastic or made out of metal or any other sufficiently strong material.

Thus, although there have been described particular embodiments of the present invention of a new and useful device for use in carpentry and painting, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device comprising:

a. a first quadrilaterally-shaped side member having a first edge, a second edge at a first obtuse angle from said first edge, a third edge at a second obtuse angle from said second edge, and a fourth edge at a first acute angle from said third edge and a second acute angle from said first side, a first point between said first edge and said second edge, a second point between said second edge and said third edge, a third point between said third edge and said fourth edge, and a fourth point between said fourth edge and said first edge;

b. a second quadrilaterally-shaped side member having a fifth edge, a sixth edge, a seventh edge, and an eighth edge, said second quadrilaterally-shaped side member being a substantial mirror image of said first quadrilaterally-shaped side member such that said fifth edge, said sixth edge, said seventh edge, and said eighth edge are respectively substantial mirror images of said first edge, said second edge, said third edge, and said fourth edge, a fifth point between said fifth edge and said sixth edge, a sixth point between said sixth edge and said seventh edge, an seventh point between said seventh edge and said eighth edge, and an eighth point between said eighth edge and said fifth edge;

c. a first surface attached to said first side member at said first edge and to said second side member at said fifth edge, said first surface joining said first side member and said second side member;

d. a second surface attached to said first side member at said second edge and to said second side member at said sixth edge, said second surface joining said first side member and said second side member;

e. a third surface attached to said first side member at said fourth point and a first intermediate point between said second point and said third point and to said second side member at said eighth point and a second intermediate point between said sixth point and said seventh point;

f. said fourth edge having first teeth proximate said third point and second teeth proximate said fourth point; and g. said eighth edge having third teeth proximate said seventh point and fourth teeth proximate said eighth point.

2. The device of claim 1 further comprising a handle attached to said first side member proximate said third point and to said second side member proximate said seventh point.

3. The device of claim 1 wherein said fourth angle is substantially thirty degrees.

4. The device of claim 1 wherein said third angle is substantially eighty degrees.

5. The device of claim 1 wherein said second angle is substantially one-hundred-and-ten degrees.

6. The device of claim 1 wherein said first angle is substantially one-hundred-and-forty degrees.

7. The device of claim 1 wherein:

a. said first side member having first ladder notch proximate said third point; and b. said second side member having second ladder notch proximate said seventh point corresponding with said first ladder notch.

8. The device of claim 1 wherein:

a. said first side member having third ladder notch proximate said fourth point; and b. said second side member having third ladder notch proximate said eighth point corresponding with said third ladder notch.

9. The device of claim 1 wherein:

a. said first side member having first ladder notch proximate said third point;

b. said second side member having second ladder notch proimate said seventh point corresponding with said first ladder notch;

c. said first side member having third ladder notch proximate said fourth point; and d. said second side member having third ladder notch proximate said eighth point corresponding with said third ladder notch.

10. The device of claim 1 wherein said first surface having a hole for receiving a nail proximate said fourth point and said eighth point.

11. A device comprising:

a. a first quadrilaterally-shaped side member having a first edge, a second edge at a first obtuse angle from said first edge, a third edge at a second obtuse angle from said second edge, and a fourth edge at a first acute angle from said third edge and a second acute angle from said first side, a first point between said first edge and said second edge, a second point between said second edge and said third edge, a third point between said third edge and said fourth edge, and a fourth point between said fourth edge and said first edge;

b. a second quadrilaterally-shaped side member having a fifth edge, a sixth edge, a seventh edge, and an eighth edge, said second quadrilaterally-shaped side member being a substantial mirror image of said first quadrilaterally-shaped side member such that said fifth edge, said sixth edge, said seventh edge, and said eighth edge are respectively substantial mirror images of said first edge, said second edge, said third edge, and said fourth edge, a fifth point between said fifth edge and said sixth edge, a sixth point between said sixth edge and said seventh edge, an seventh point between said seventh edge and said eighth edge, and an eighth point between said eighth edge and said fifth edge;

c. a first surface attached to said first side member at said first edge and to said second side member at said fifth edge, said first surface joining said first side member and said second side member;

d. a second surface attached to said first side member at said second edge and to said second side member at said sixth edge, said second surface joining said first side member and said second side member;

e. a third surface attached to said first side member at said fourth point and a first intermediate point between said second point and said third point and to said second side member at said eighth point and a second intermediate point between said sixth point and said seventh point;

f. said fourth edge having first teeth proximate said third point and second teeth proximate said fourth point;

g. said eighth edge having third teeth proximate said seventh point and fourth teeth proximate said eighth point;

h. a handle attached to said first side member proximate said third point and to said second side member proximate said seventh point;

i. said fourth angle is substantially thirty degrees;

j. said third angle is substantially eighty degrees;

k. said second angle is substantially one-hundred-and-ten degrees;

l. said first angle is substantially one-hundred-and-forty degrees;

m. said first side member having first ladder notch proximate said third point;

n. said second side member having second ladder notch proximate said seventh point corresponding with said first ladder notch;

o. said first side member having third ladder notch proximate said fourth point;

p. said second side member having third ladder notch proximate said eighth point corresponding with said third ladder notch; and q. said first surface having a hole for receiving a nail proximate said fourth point and said eighth point.

* * * * *